US007815182B2

(12) United States Patent
Sciurba et al.

(10) Patent No.: US 7,815,182 B2
(45) Date of Patent: Oct. 19, 2010

(54) METHOD FOR CONTROLLING STACK-ADVANCING IN A REPRODUCTION APPARATUS

(75) Inventors: Thomas K. Sciurba, Webster, NY (US); James A. Zimmer, Jr., Gates, NY (US); Michael T. Dobbertin, Honeoye, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/393,149

(22) Filed: Feb. 26, 2009

(65) Prior Publication Data

US 2009/0166950 A1 Jul. 2, 2009

Related U.S. Application Data

(62) Division of application No. 10/668,417, filed on Sep. 23, 2003, now abandoned.

(51) Int. Cl.
*B65H 3/44* (2006.01)
*B65H 5/26* (2006.01)

(52) U.S. Cl. ..... 271/9.02; 271/9.03; 271/9.05

(58) Field of Classification Search ..... 271/9.02, 271/9.03, 9.05, 152, 153, 159, 258.01, 265.01, 271/121

See application file for complete search history.

(56) References Cited

U.S. PATENT DOCUMENTS

| | | | | |
|---|---|---|---|---|
| 4,265,440 | A | 5/1981 | Shibazaki et al. | |
| 4,535,463 | A | 8/1985 | Ito et al. | |
| 4,815,725 | A | 3/1989 | Kanaya | |
| 5,028,041 | A | 7/1991 | Kobayashi | |
| 5,102,112 | A | 4/1992 | Takahashi | |
| 5,344,133 | A | 9/1994 | Jantsch et al. | |
| 5,347,350 | A | 9/1994 | Nakahata et al. | |
| 5,472,183 | A | 12/1995 | Kubo | |
| 5,823,527 | A | 10/1998 | Burlew et al. | |
| 5,971,387 | A | 10/1999 | Kita | |
| 6,485,013 | B2 | 11/2002 | Slippy et al. | |
| 6,685,181 | B2 | 2/2004 | Bakodledis | |
| 2002/0066313 | A1 | 6/2002 | Slippy et al. | |
| 2003/0015836 | A1 | 1/2003 | Westcott et al. | |
| 2004/0061280 | A1 * | 4/2004 | Sciurba et al. | 271/152 |
| 2004/0135307 | A1 * | 7/2004 | Dobbertin et al. | 271/152 |
| 2007/0096387 | A1 * | 5/2007 | Sciurba et al. | 271/152 |

FOREIGN PATENT DOCUMENTS

| | | |
|---|---|---|
| EP | 0 340 135 | 11/1989 |
| EP | 0 899 227 | 3/1999 |
| JP | 60 188244 | 9/1985 |
| JP | 60 188245 | 9/1985 |

* cited by examiner

*Primary Examiner*—David H Bollinger
(74) *Attorney, Agent, or Firm*—Donna P. Suchy

(57) ABSTRACT

The present invention relates to a method for providing paper stack level calibration in a reproduction apparatus. According to various aspects of the invention, methods are provided for continuous feeding with a transition from one supply to another, and leaving a controlled number of sheets in the prior supply.

4 Claims, 6 Drawing Sheets

METHOD FOR CONTROLLING STACK-ADVANCING IN A REPRODUCTION APPARATUS

CROSS-REFERENCE TO RELATED APPLICATIONS

This application is a Divisional application of U.S. patent application Ser. No. 10/668,417, filed on Sep. 23, 2003, now abandoned by Thomas K. Sciurba, et al., entitled "METHOD FOR CONTROLLING STACK-ADVANCING IN A REPRODUCTION APPARATUS" hereby incorporated by reference and herein assigned to the Eastman Kodak Company.

FIELD OF THE INVENTION

The present invention relates to a method for providing paper stack level calibration in a reproduction apparatus.

BACKGROUND OF THE INVENTION

In typical reproduction devices, such as copiers or printers, for example, information is reproduced on individual cut sheets of receiver material such as plain bond or transparencies. Receiver sheets of the various types are stored in stacks and respectively fed seriatim from such stacks when copies are to be reproduced thereon. The sheet feeder for the reproduction devices should be able to handle a wide range of sheet types and sizes reliably and without damage. Desirably, the sheets are accurately fed individually from the sheet stack without misfeeds or multifeeds.

Reproduction device sheet feeders are typically of two types, vacuum feeders or friction feeders. An exemplary vacuum sheet feeder is shown in U.S. Pat. No. 5,344,133, issued Sep. 6, 1994, in the name of Jantsch et al. In such an apparatus, a stack of sheets is stored in a supply hopper. A sheet feed head assembly, including a plenum, a vacuum source in flow communication with the plenum, and a mechanism, such as a feed belt associated with the plenum, transports a sheet acquired by vacuum in a sheet feeding direction away from the sheet supply stack.

Typically, in most vacuum sheet feeders, the sheet supply stack is supported to maintain the topmost sheet at the feed head assembly. A first positive air supply then directs a flow of air at the sheet supply stack to levitate the top several sheets in the supply stack to an elevation enabling the topmost sheet to be acquired by vacuum from the sheet feed head assembly plenum. Additionally, a second positive air supply typically directs a flow of air at an acquired sheet to assure separation of any additional sheets adhering to such topmost sheet.

It is clear that the sheet stack should be maintained in a particular positional relation with the sheet feed head assembly to assure desired feed from the stack. An exemplary control of a sheet stack is shown in U.S. Pat. No. 5,823,527 issued Oct. 20, 1998, in the name of Burlew et al. In such an apparatus, a sheet feeder is disclosed having a platform for supporting a stack of sheets, a feed head assembly for feeding sheets seriatim from the top of a sheet supply stack on the platform, a mechanism for moving the platform relative to the feed head assembly, and device for controlling operation of the platform moving mechanism. The control device can determine a selected parameter in response to examination of sheet stack parameters, and consequently produce a signal corresponding thereto. The speed of the platform moving mechanism is then set based on the parameter signal.

Modern reproduction devices have more than one sheet feeder to store different types of sheets. When running large print jobs without any stop page there is a need to switch over from one feeder to another. Normally the first stack is not run empty before switching over to the next stack. It is preferred to leave the minimum number of sheets necessary to insure that the feed source will not run out prior to switching. This maximizes the effective capacity of the supplies and minimizes the number of sheets that are likely to be exposed to undesirable environments for an extended period of time as a result of being left behind. Normally, feeding is switched to another feed source when a paper low condition is signaled. This is typically determined by sensing that the platform has reached a certain position, either through action of a switch, or feedback from a platform travel monitor, such as an encoder, potentiometer or step count from a step motor. The actuation point for this paper low condition is selected to insure that a sufficient number of receiver sheets is present to allow switching under all conditions. Due to the system architecture, the system tolerances and differences in the receiver sheet thickness, this actuation point is selected conservatively. This results in an excessive number of sheets remaining under most conditions.

The stack advancing is often performed with stepper motors. The height position of the stack is proportional to the number of steps a stepper motor is triggered. The paper supply controller needs data relating to the displacement of the stack supporting platform relative to a down switch for several reasons. The displacement data is used to determine the paper low status as well as enabling the paper out check and other functions. The paper low displacement is one parameter that determines how many sheets are left behind in a supply hopper after a continuous mode swap, wherein paper supplies are switched and filled alternately in order to provide continuous stream of sheets to the marking engine. As mentioned before, the displacement can be measured in terms of stepper motor steps applied. The mechanical tolerances in the stack advancing mechanism are such that no nominal value for each of these displacements would give an acceptable performance for all supplies of the reproduction apparatus. Although it is possible to manually calibrate the total possible displacement of an elevator, it is inconvenient to manually calibrate for paper thickness.

The embodiments described herein allow for more effectively controlling the level of a sheet stack and the switching over to the next stack.

SUMMARY OF THE INVENTION

According to various aspects of the invention, methods are provided for continuous feeding with a transition from one supply to another, and leaving a controlled number of sheets in the prior supply.

DETAILED DESCRIPTION OF THE INVENTION

Addressing the problems with paper feeder supplies in reproduction devices described above, the present embodiments provide effective control of a paper stack in a reproduction apparatus with the capability of increasing the effective receiver sheet capacity.

According to an aspect of the present invention, the control of stack-advancing may be characterized by an elevator step calibration management system whereby each supply will calibrate itself for both the total possible displacement and the paper low displacement of a stack supporting platform. The calibration occurs in a fashion that is both continuous and independent from the user. The calibration procedure could be performed every time a stack has been renewed or the sheet attributes were changed.

According to another aspect of the invention, the number of elevator steps counted during the calibration procedure could be checked with preset values to eliminate malfunctions in the stack advancing control and devices.

According to another aspect of the invention the data derived from the calibration procedure could be used to control the switching over to the next stack and to calculate the limits for declaring elevator movement problems.

The present invention provides a number of advantages and applications as will be readily apparent to those skilled in the art. Utilizing the disclosed methods, the present invention allows increased effective receiver capacity without increasing the risk of running out of paper while feeding sheets and switching over to another stack.

The present embodiments described herein, provide the ability to more effectively control a paper stack in a reproduction device. The system and method have been implemented in a reproduction device utilizing a top feed vacuum feeder. However, it should be understood that the present embodiments can be implemented in a reproduction device that utilizes other types of feeders, including variations of the vacuum feeder or a friction feeder. Thus, the exemplary embodiments disclose a system and method that can be utilized to increase the efficiency for any type of reproduction machine.

Figure 1:
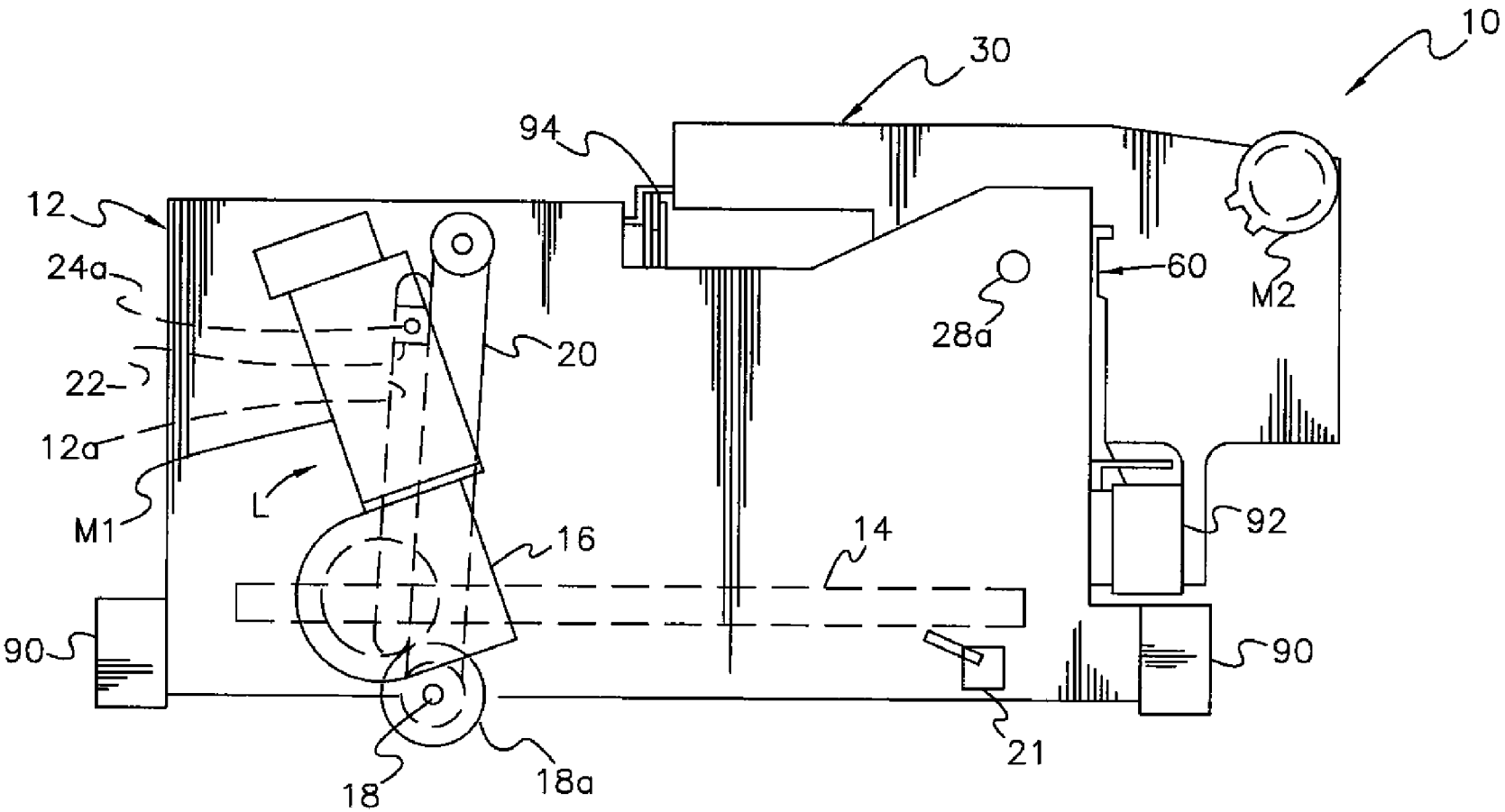
FIG. 1 is a side elevational view of an exemplary receiver sheet supply and feeding apparatus.

FIG. 1 is a side elevational view of an exemplary receiver sheet supply and feeding apparatus according to one aspect of the invention. The receiver sheet supply and feeding apparatus 10 generally includes an open hopper 12 and an elevating platform 14 for supporting a stack of sheets. The sheet stack (not shown in FIG. 1) supported on the platform 14 contains individual sheets suitable, for example, for serving as receiver sheets for having reproductions formed thereon in a copier or printer device. Sheets for receiving reproductions may be selected from a wide variety of materials and sizes, which altogether define the sheet attributes. For example, the sheets may be of a weight in the range of 49 grams per square meter ("gsm") to 300 gsm index, and a site in the range of 8.times.10 inches to 14.times.18 inches, or larger, or smaller, depending upon the application.

The sheet stack supporting platform 14 is supported within the hopper 12 for substantially vertical elevational movement by a lifting mechanism ("L"). Preferably, the lifting mechanism L serves to raise the platform 14 to an elevation for maintaining the topmost sheet in the stack at a predetermined level during operation of the receiver sheet supply and feeding apparatus 10, and to lower the platform to permit adding sheets thereto. The lifting mechanism L may include a motor ("M.sub.1"), attached to the outside of the upstanding front wall of the hopper 12. Preferably, the motor M.sub.1 rotates a gear set 16 mounted on a shaft 18 extending from the upstanding rear wall of the hopper 12. A pair of sprocket mounted lifting chains 20 are respectively interconnected by gears with the shaft 18 to be moved about a closed loop path when the shaft 18 is rotated by the motor M.sub.1. As shown in FIG. 1, the sheet stack supporting platform 14 is shown in its lowest position in phantom. This most bottom position of the platform 14 is detected with a down switch 21.

Figure 2:
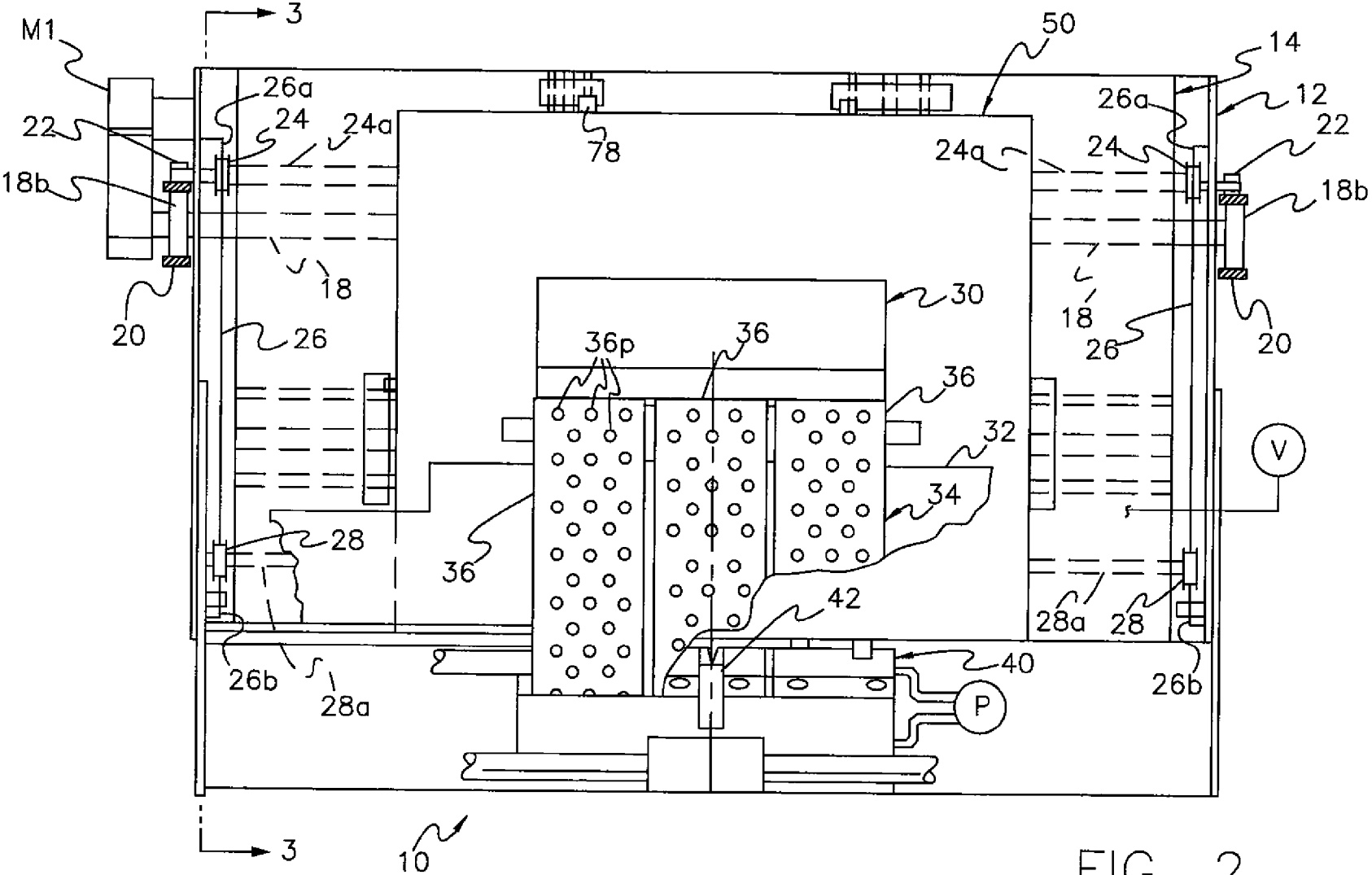
FIG. 2 is a top plan view of the receiver sheet supply and feeding apparatus of FIG. 1, with portions removed or broken away to facilitate viewing.

FIG. 2 is a top plan view of the receiver sheet supply and feeding apparatus 10 of FIG. 1, with portions removed or broken away to facilitate viewing of a sheet feed head assembly 30. The sheet feed head assembly 30 is generally located in association with the hopper 12, so as to extend over a portion of the platform 14 in spaced relation to a sheet stack 50 supported thereon. The sheet feed head assembly 30 includes a ported plenum 32 connected to a vacuum source V, and an air jet device 40 connected to a positive pressure air source P. Preferably, the positive pressure air jet from the air jet device 40 levitates the top several sheets in the supported sheet stack 50, while the vacuum at the plenum 32 is effective through its ports to cause the topmost levitated sheet from the stack 50 to thereafter be acquired at the plenum 32 for separation from the sheet stack 50. Additional positive pressure air jets from the air jet device 40 helps to assure separation of subsequent sheets from the acquired topmost sheet. To further assure separation of sheets from the sheet stack, the lifting mechanism (for example, L in FIG. 1) preferably presents the top sheet a specified distance from the vacuum plenum 32.

Figure 3:
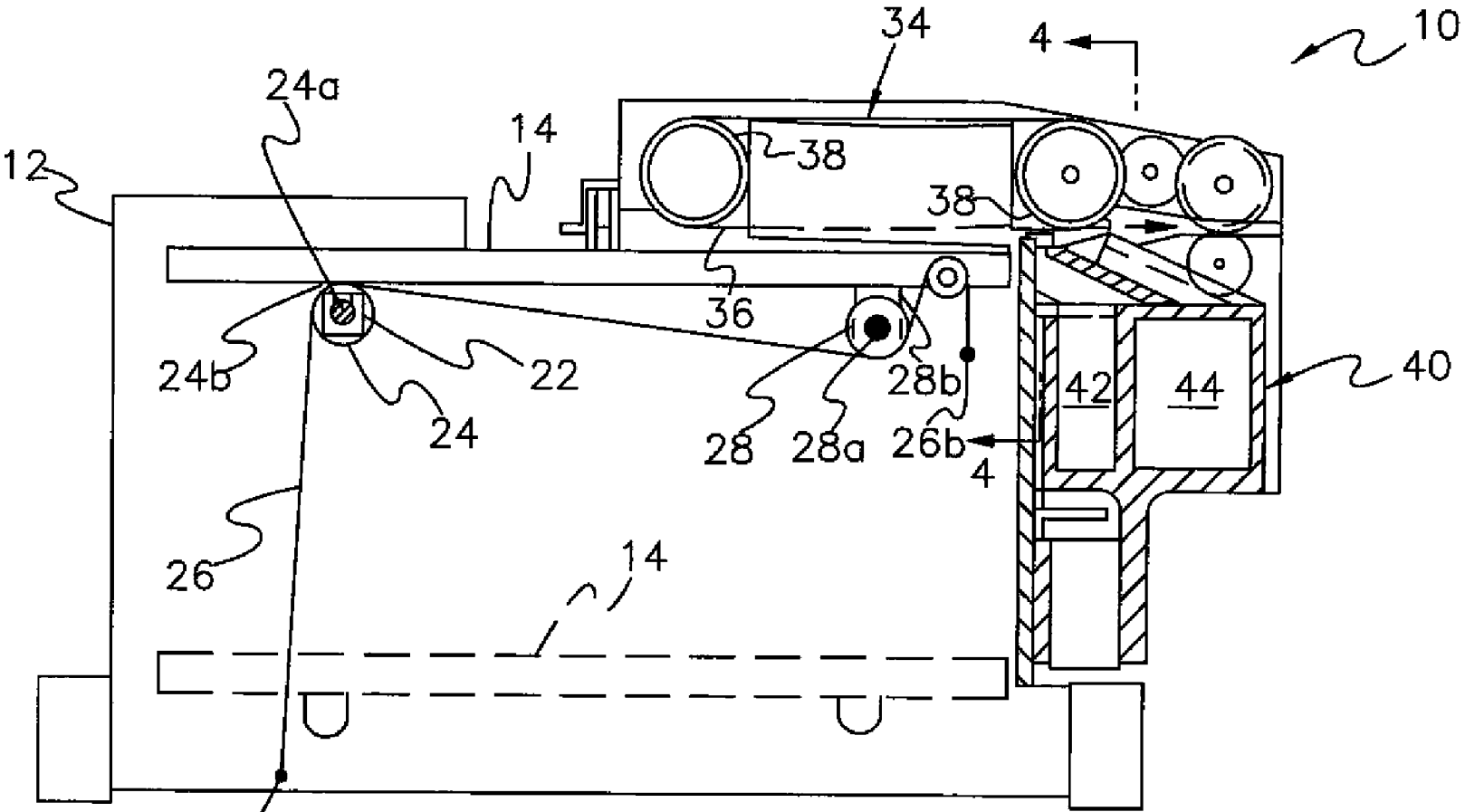
FIG. 3 is a side elevational view of a cross-section of the receiver sheet supply and feeding apparatus taken along lines 3-3 of FIG. 2, particularly showing the platform elevating mechanism.

FIG. 3 is a side elevational view of a cross-section of the exemplary receiver sheet supply and feeding apparatus 10 taken along lines 3-3 of FIG. 2, particularly showing the platform 14 lifting mechanism. Each of the lifting chains have a link 22 extending through respective slots 12*a* (FIG. 1) in the front and rear upstanding walls of the hopper 12. The links 22 are connected to a shaft 24*a* supported in brackets 24*b* extending from the underside of the platform 14. Tension cables 26 are respectively connected, at the ends 26*a*, 26*b* thereof, to the front and rear upstanding wall of the hopper 12. The cables 26 are respectively threaded over their associated first pulleys 24 and under second pulleys 28 mounted on a shaft 28*a* supported in the brackets 28*b* extending from the underside of the platform 14.

In FIG. 3, the sheet stack supporting platform 14 is shown in its most elevated position in solid lines, and in its lowest position in phantom. During the operation of the lifting mechanism L, an appropriate signal to the motor M.sub.1 causes the motor to rotate the gear set 16 (FIG. 1), such as either clockwise to lower the platform 14 toward the lowest position or counterclockwise to raise the platform toward its most elevated position. Rotation of the gear set 16 moves the lifting chains 20 (FIG. 1) in their closed loop paths, thereby imparting vertical movement to the links 22. This movement, in turn, moves the shaft 24*a*, and thus the platform 14, and as well as its brackets 24*b* and first pulleys 24. The platform 14 is maintained substantially level in its movement by the action of the tension cables 26, which cooperatively move the second pulleys 28, and thus, the shaft 28*a* and the brackets 28*b* of the platform 14.

Figure 4:
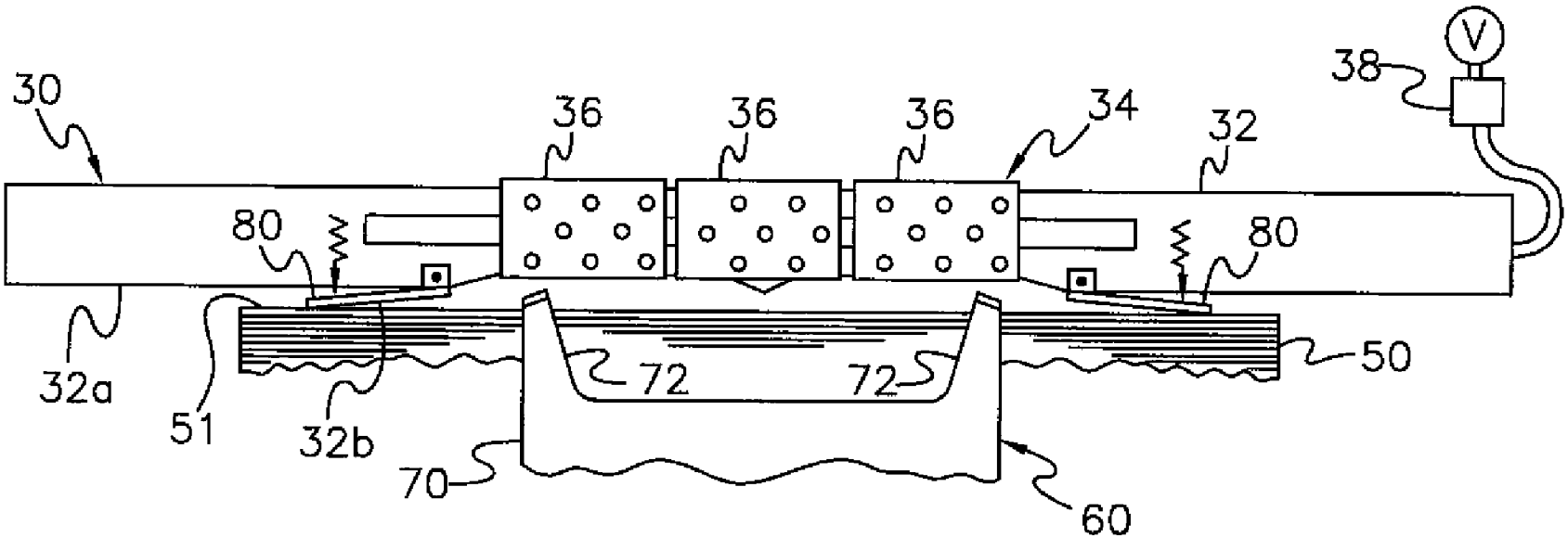
FIG. 4 is an end view, on an enlarged scale and with portions removed, of a portion of the receiver sheet supply and feeding apparatus, particularly showing the feed head assembly thereof, taken along the lines 4-4 of FIG. 3.

FIG. 4 is an end view, on an enlarged scale and with portions removed, of a portion of the receiver sheet supply and feeding apparatus 10, particularly showing the feed head assembly 30 thereof, taken along the lines 4-4 of FIG. 3. Preferably, maintaining the topmost sheet 51 at the predetermined level is accomplished by one or more sheet detecting switches 80, which controls the operation of the motor M.sub.1 for actuating the lifting mechanism L, (more described below), to raise the platform 14 through a predetermined increment. On the other hand, lowering of the platform 14 is usually accomplished by some externally produced signal to the motor which tells the motor to rotate until the platform 14 reaches the down switch 21 that signals the motor M.sub.1 to stop, often bringing the platform 14 to its lowest position.

Of course, other precisely controllable lifting mechanisms, such as worm gears, lead screws, or scissors linkages are suitable for use in the elevation control for the sheet stack supporting platform 14 according to these embodiments, and other suitable mechanisms without limitation.

Preferably, the lower surface 32*a* of the plenum 32 of the sheet feed head assembly 30 has a particularly configured shape, so as to provide for a specific corrugation of an acquired sheet 51. As the top sheets 51 in the supported sheet stack 50 are levitated, the topmost sheet 51 preferably contacts the outer winged portions 32*b* of the surface 32*a*. A minimal pressure is exerted on the sheet 51 to help in forming a controlled corrugation to the sheet 51. This establishes a consistent spacing for the center portion of the sheet 51 from the center portion of the plenum 32. As such, the access time for a sheet 51 to be acquired at the plenum 32 is often repeatably consistent and readily predictable.

The interactions of the plenum 32 and the air jet device 40 attempt to assure that control over the sheet 51, as it is acquired at the plenum 32, is not lost. Further, corrugation of the sheet 51 contorts the sheet 51 in an unnatural manner. Since subsequent sheets 51 are not subjected to the same forces, at the same time, as is the topmost sheet 51, such subsequent sheets 51 are unable to contort in the same manner. Accordingly, the subsequent sheets 51 are effectively separated from the topmost sheet 51 as it is being acquired at the plenum 32.

As noted above, it is important for proper operation of the sheet supply and feeding apparatus 10, according to this embodiment, for the level of the topmost sheet 51 in the stack 50 supported on the platform 14 to be maintained at a predetermined height relative to the plenum 32. The level is selected to be in a range where the topmost sheet 51, when levitated by the first air jet arrangement 42, is close enough to the plenum 32 to be readily acquired by the vacuum forces from the plenum 32, within a repeatable time frame, but yet far enough away from the plenum 32 to assure that the sheet being acquired is not pinned against the plenum 32.

Preferably, each of the switches 80, as noted above, are designed to detect the level of the topmost sheet 51. Such switches 80, as known in the art, could be for example, a paper guide that rides against the sheet 51 with very little downward pressure, at the highest level of acceptable corrugation, as found in U.S. Pat. No. 5,823,527, in the name of Burlew et al. Additionally, paper level actuators could be integrated into an optical switch so as to cause limited pressure on the sheet 51. The switches 80 can be read during the feed interval, and if necessary, will transmit a signal to the lifting mechanism L to raise the platform 14 in one or more increments. Preferably the increments can maintain the proper sheet level. The location of the switches 80 at the highest level of acceptable corrugation is an advantage in that each of the switches 80 can sense the location of sheets 51 which may be severely curled and still not pin the sheet 51 to the plenum 32.

Referring back to FIG. 1, to further assure separation of sheets from the sheet stack and the switching over to another stack, the lifting mechanism L can present the top sheet a desirable distance from the vacuum plenum, in response to a second signal that originates from a secondary source other than the switches 80, such as by a microprocessor 90 executing source code, or hardware logic.

Figure 5:
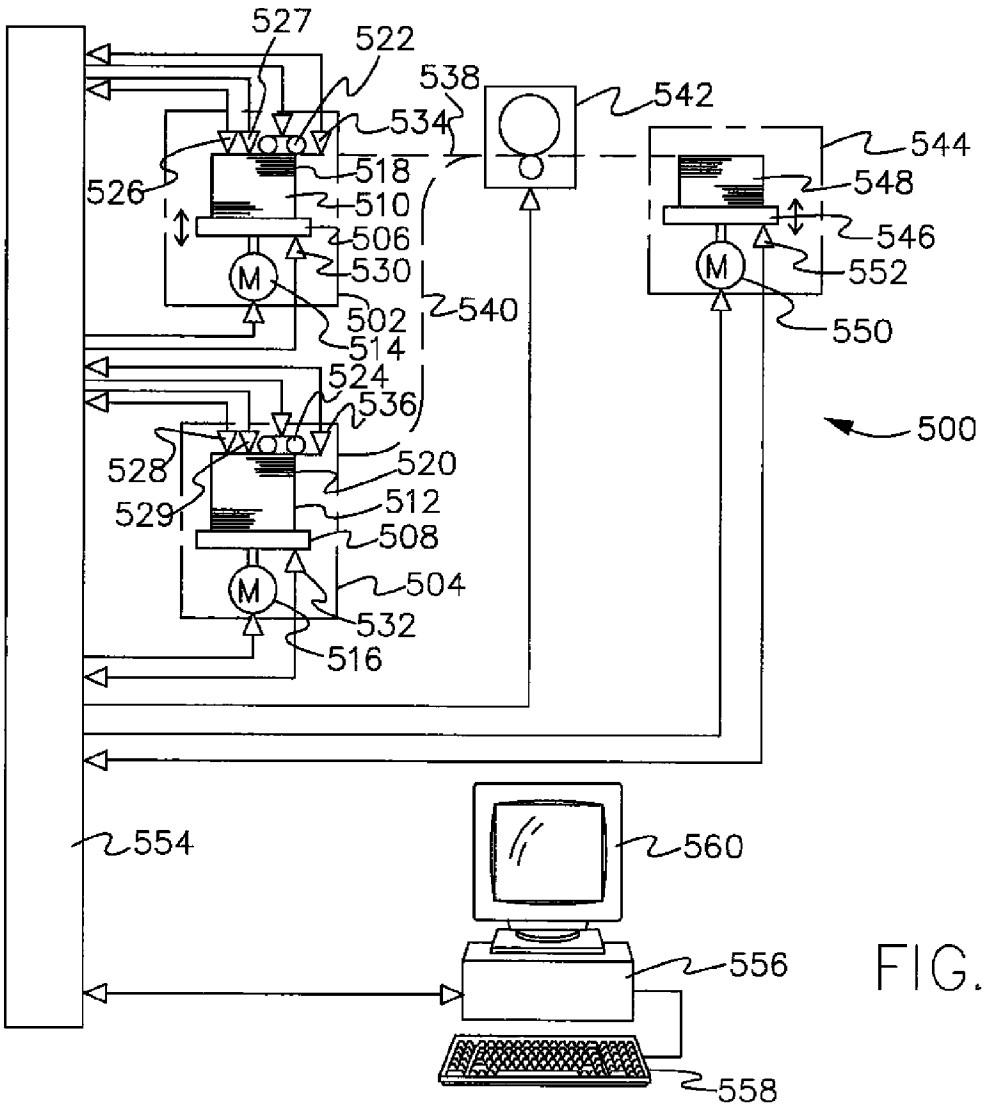
FIG. 5 is a schematic illustration of an exemplary reproduction device with two feeding apparatuses.

FIG. 5 is a scheme illustrating an exemplary reproduction device 500 with two feeding apparatuses 502, 504 similar as described above with FIGS. 1-4. In each of feeding apparatus 502, 504 there is a platform 506, 508 supporting stack 510, 512. The platform 506, 508 is coupled with an elevating stepper motor 514, 516. Sheets 518, 520 in a stack 510, 512 are separated and transported by a feed head assembly 522, 524. The stack height is measured with level sensors 526, 528. An additional paper out sensor 527, 529 gives a signal if no sheet 518, 520 is remaining on the platform 506, 508. A reference position of the platform 506, 508 is detected with down switches 530, 532. To count the number of separated and transported sheets 518, 520 an optical edge sensor 534, 536 is arranged in the transport path 538, 540. The sheets 518, 520 are transported to a printing unit 542. After printing the sheets 518, 520 are discarded in a piling apparatus 544. The piling apparatus contains a platform 546 to discard the sheets 518, 520 in a stack 548. The stack 548 is lowered with the help of a stepper motor 550 whereby the bottom position is detected with a down switch 552.

As shown in FIG. 5 all active and sensor elements are connected to a control system 554 for the reproduction device 500. To input, process and display data the control system 554 is connected to a computer system 556 with a keyboard 558 and a monitor 560. Preferably, software for controlling feeding, of types known in the art, is modified in accordance with the present invention to provide the functionality described herein.

Figures 6, 7, 8, 9:
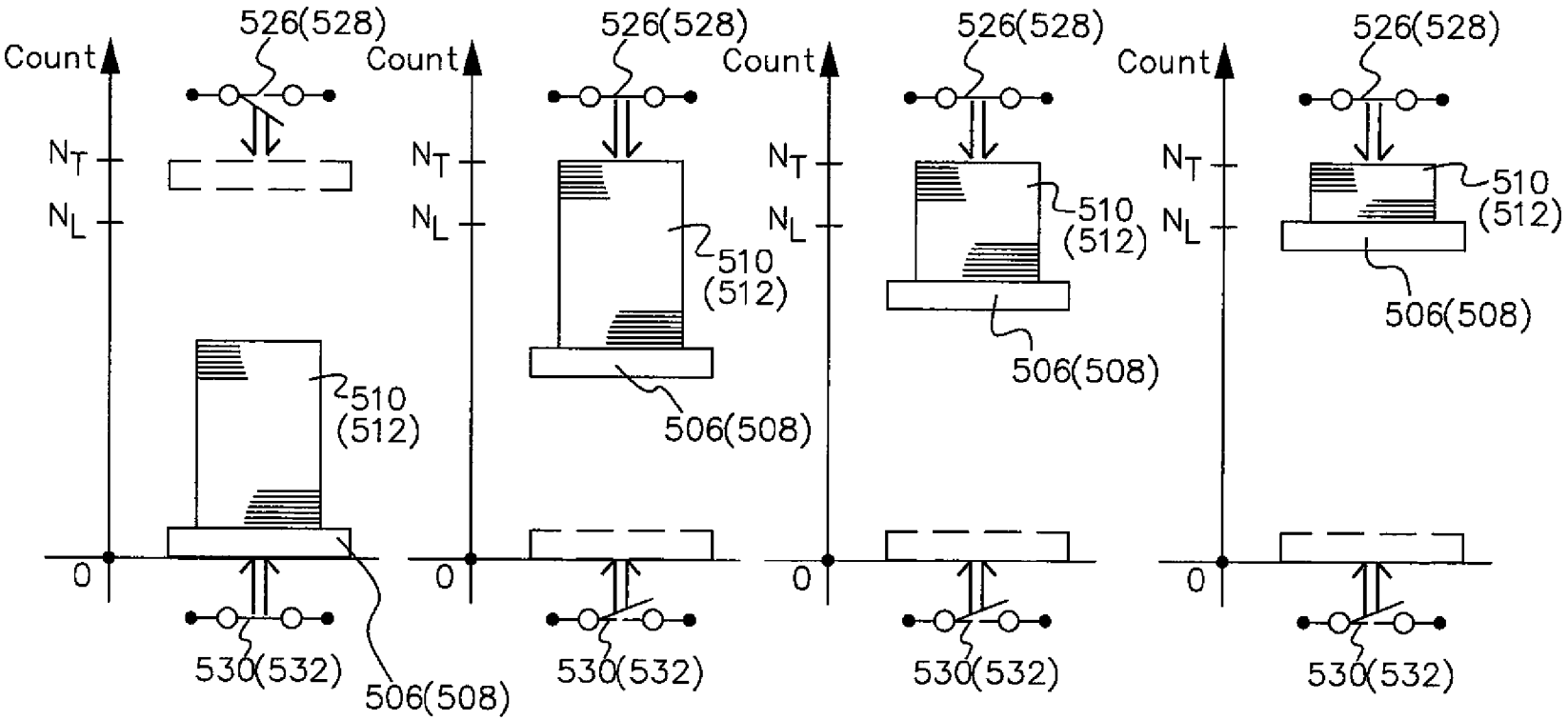
FIGS. 6-9 present schematic illustrations of a different stack advancing scenes according to further aspects of the invention.

With FIGS. 6-9 it will be described below how the stack-advancing may be performed according to various further aspects of the invention. Referring now to FIG. 6 (with reference to FIG. 5), a first procedure is presented wherein a number of steps needed to advance the stacks 510, 512 from a bottom most to a top most position is determined. This procedure is preferably done when the printing unit 500 is manufactured and the feeding apparatuses 502, 504 are mounted, or by field service if they have to be changed or repaired. After starting the procedure by calling up a program in the computer system 556, first a total possible displacement count is initialized to a nominal value N.sub.T. The initialized value N.sub.T is stored in Non-Volatile Memory ("NVM", for example battery-backed memory, flash memory, etc.), also referred to herein as "persistent memory", within the control system 554. Next a complete stack 510, 512 is advanced stepwise with the stepper motor 514, 516 while sheets 518, 520 are separated with the head assembly 522, 524. This is performed with the control system 554. Just before every feed the current step count N.sub.T,C of the motor 514, 516 is recorded. A successful feed is verified with a signal from the edge sensor 534, 536. This procedure goes on until the paper out sensor 527, 529 generates a paper out signal. If so, the current step count N.sub.T,C, which is the total number of steps needed to feed a stack of sheets starting from the initial lowest position of platform 506, 508, is saved as the new total possible displacement count N.sub.T in the NVM memory, thereby overwriting the nominal initialized value N.sub.T.

In FIG. 6 there is shown a platform 506, 508 in a bottom-most position (solid lines) and a top-most position (dashed lines). The just-described procedure starts at the bottom-most position where the platform 506, 508 closes the down switch 530, 532. This responds to the reference position with the step count zero. In vertical direction the step count is shown. After feeding all sheets 510, 512 the empty platform 506, 508 would activate the level sensor 526, 528 in the top-most position. In this position the step count reaches N.sub.T.

The new total possible displacement count N.sub.T may be checked to determine whether it lies in a predetermined range of values. If not an error message may be displayed on the monitor 560. In this case a service person could do further checking.

Referring now to FIGS. 5 and 6, the number of steps needed for the stepper motor 514 (FIG. 5) to advance the stack 510 for feeding K sheets may be determined, wherein K is the number of sheets 518 that should remain in the stack 510 before the scheduling of future feeding goes to the other stack 512 in a continuous mode. For example, K may be the maximum number of sheets that can potentially be scheduled in advance. This paper low displacement procedure is automatically realized by recording the number of steps N.sub.K required to feed K sheets at some point during the reproduction process before only K sheets are left in the stack 510, 512.

A paper-low value, N.sub.L, may be determined by subtracting N.sub.K from N.sub.T. N.sub.L may be used to signal a user that paper is almost out in a particular hopper, or it may be used to initiate transfer to another paper supply when paper is feeding in continuous mode. Preferably, K corresponds to a number of sheet feeds already fed from a corresponding supply before N.sub.L is reached. This value N.sub.L is also stored in the memory, preferably volatile Random Access Memory (RAM) rather than NVM.

The system may be initialized with a value N.sub.L that represents a nominal paper-low value. For example, if it is determined that an access to the hopper 12 of apparatus 502 or 504 or a paper attributes change occurred, a paper-low displacement count may be initialized to a nominal low paper value N.sub.L. N.sub.L may be chosen to either correspond to a thickest possible paper to ensure that paper will never run out in a drawer or N.sub.L may be chosen to correspond to a thinnest possible paper to ensure that excess paper is not left in a drawer.

With the motor 514 the stack is advanced up to the level of the feed-head assembly 522, as shown in FIG. 7. The arrival at the feed-head assembly is confirmed by the level sensor 526. After the level sensor 526 is activated the current step count is recorded as N.sub.0 in the memory. K sheets are fed, and the corresponding step count N.sub.1 is recorded. The number of step counts corresponding to K sheets is N.sub.K=N.sub.1−N.sub.0. Finally a new paper low nominal value N.sub.L may be calculated as the difference between the total possible displacement N.sub.T and N.sub.K, N.sub.L=N.sub.T−N.sub.K. The stack 510 has now the position shown in FIG. 8.

After determining the paper low value, N.sub.L, feeding may continue until the actual step count reaches N.sub.L. The platform 506 has then the level shown in FIG. 9. The scheduling from stack 510 will be stopped and is continued with feeding apparatus 504 activated with the control system 554. The feeding out of apparatus 504 is done in the same way as described with feeding apparatus 502.

While the switching over from one feeding apparatus 502 to the next feeding apparatus 504 has been described with the remaining sheet number K, it should be clear that the switching over could be delayed by feeding J additional sheets with the feeding apparatus 502. For example, after paper low N.sub.L is reached, allow scheduling of J additional feeds in a manner to insure that not more than K feeds occur from that point prior to switching the supplies. I.e., if six additional feeds (J) are scheduled when paper low N.sub.L is reached, allow K−6 (k−J) more feeds to be scheduled prior to switching to feeding apparatus 504.

The present embodiments described herein, provide the ability to more effectively and reliably control stack-advancing in a reproduction device, by automatically calibrating the counts for the stepper motors M1, 514, 516. Although described in the setting of a reproduction device utilizing a top feed vacuum feeder 502, 504 and switches 80, 526, 528 that generate a signal to indicate an increment, it should be understood that the present embodiments could be implemented in a reproduction device that utilizes other types of feeders and switches, or in an off-line configuration (a paper supply not connected to a reproduction device), or with a post-fuser inserter.

The disclosed method provides a number of advantages and applications. Utilizing the disclosed embodiments, the present invention allows better control over the number of sheets remaining during a continuous mode swap even if the sheet attributes and the mechanical tolerances change or vary from stack to stack.

It should also be understood that the programs, processes, methods and systems described herein are not related or limited to any particular type of hardware, such as TTL logic or computer software, or both. Various types of general purpose or specialized processors, such as microcontrollers may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the drawings and signals may include analog, digital, or both. While various elements of the preferred embodiments have been described as being implemented in hardware, in other embodiments in software implementations may alternatively be used, and vice-versa. For example, the said stepper motor, could be any type of motor with feedback for platform movement such as an encoder or a potentiometer.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

The invention claimed is:

1. A method for controlling sheet stack advancing, comprising: determining a sheet thickness by measuring a displacement of a platform corresponding to a known number of sheet feeds by said feedhead, said sheets resting upon said platform; determining a distance of said platform relative to a feedhead corresponding to a predetermined number of sheets having said sheet thickness to be left in a sheet supply; switching scheduling of future feeds to another sheet supply when said platform is said distance from said feedhead.

2. The method of claim 1, further comprising driving said platform with a stepper motor, and expressing said distance as stepper motor counts.

3. The method of claim 1, further comprising determining said distance prior to said platform being at said distance relative to said feedhead.

4. The method of claim 1, further comprising storing said distance in memory.

* * * * *